US010594068B2

(12) United States Patent
Duong

(10) Patent No.: US 10,594,068 B2
(45) Date of Patent: Mar. 17, 2020

(54) RETENTION OF ELECTRICAL SPRING CONTACTS FOR WET CONNECTION OF DOWN-HOLE TOOL COMPONENTS

(71) Applicant: Prime Downhole Manufacturing LLC, Houston, TX (US)

(72) Inventor: Khanh Anh Duong, Houston, TX (US)

(73) Assignee: PRIME DOWNHOLE MANUFACTURING LLC, Houston, TX (US)

( * ) Notice: Subject to any disclaimer, the term of this patent is extended or adjusted under 35 U.S.C. 154(b) by 15 days.

(21) Appl. No.: 15/117,316

(22) PCT Filed: Feb. 12, 2015

(86) PCT No.: PCT/US2015/015593
§ 371 (c)(1),
(2) Date: Aug. 8, 2016

(87) PCT Pub. No.: WO2015/123407
PCT Pub. Date: Aug. 20, 2015

(65) Prior Publication Data

US 2016/0359252 A1 Dec. 8, 2016

Related U.S. Application Data

(60) Provisional application No. 61/939,623, filed on Feb. 13, 2014.

(51) Int. Cl.
*H01R 13/17* (2006.01)
*E21B 17/02* (2006.01)
(Continued)

(52) U.S. Cl.
CPC ..... *H01R 13/17* (2013.01); *E21B 17/028* (2013.01); *E21B 33/0385* (2013.01); *H01R 13/5219* (2013.01)

(58) Field of Classification Search
CPC .... H01R 13/17; E21B 17/028; E21B 33/0385
See application file for complete search history.

(56) References Cited

U.S. PATENT DOCUMENTS 3,930,545 A * 1/1976 Sears ..... E21B 4/02 175/103
5,820,416 A 10/1998 Carmichael
(Continued)

FOREIGN PATENT DOCUMENTS

CN 102356518 A 2/2012
EP 2267846 A1 12/2010
(Continued)

OTHER PUBLICATIONS

Machine Translation and First Office Action and Search issued in connection with corresponding CN Application No. 201580008524.8 dated Jul. 31, 2017.
(Continued)

*Primary Examiner* — David J Bagnell
*Assistant Examiner* — Manuel C Portocarrero
(74) *Attorney, Agent, or Firm* — King & Spalding LLP

(57) ABSTRACT

A wet connect apparatus operable in a down-hole environment includes an annular electrical contact, which includes a resilient outer member constructed of coiled spring having its ends fused together, and also includes an inner retention member constructed of a gift ring embedded or installed within the resilient outer member. The inner retention member provides a radial bias to retain the annular electrical contact within an electrically conductive groove during installation and assembly of the wet connect apparatus.

19 Claims, 3 Drawing Sheets

(51) Int. Cl.

| | |
|---|---|
| ***E21B 33/038*** | (2006.01) |
| ***H01R 13/52*** | (2006.01) |
| ***E21B 17/00*** | (2006.01) |

(56) References Cited

U.S. PATENT DOCUMENTS

| | | | | |
|---|---|---|---|---|
| 2006/0051996 | A1 | 3/2006 | Panzar et al. | |
| 2008/0047703 | A1 | 2/2008 | Stoesz et al. | |
| 2013/0319685 | A1* | 12/2013 | Pike | E21B 41/00 166/378 |

FOREIGN PATENT DOCUMENTS

| | | | |
|---|---|---|---|
| GB | 2127626 | A | 4/1984 |
| RU | 2435928 | C2 | 12/2011 |
| WO | 2010/122342 | A1 | 10/2010 |

OTHER PUBLICATIONS

A Russian Office Action issued in connection with corresponding RU Application No. 2016132369 dated Aug. 1, 2018.
International Search Report and Written Opinion issued in connection with corresponding Application No. PCT/US2015/015593 dated Jun. 2, 2015.

* cited by examiner

RETENTION OF ELECTRICAL SPRING CONTACTS FOR WET CONNECTION OF DOWN-HOLE TOOL COMPONENTS

CROSS-REFERENCE TO RELATED APPLICATIONS

This application is a national state application under 35 U.S.C. § 371(c) of prior filed, co-pending PCT application serial number PCT/US2015/015593, filed on Feb. 12, 2015 which claims priority to U.S. Provisional Patent Application Ser. No. 61/939,623, titled "Retention of Electrical Spring Contacts for Wet Connection of Down-Hole Tool Components" filed 13 Feb. 2014. The above-listed applications are hereby incorporated by reference in their entirety.

BACKGROUND

Technical Field

The present embodiments relate in general to establishing electrical connections in a down-hole environment. More specifically, embodiments relate to retaining ring contacts of an electrical connector arranged for connecting down-hole tool components in a wet environment.

Description of the Related Art

Often instruments and tools are positioned at down-hole locations within a wellbore to detect well conditions and control the operation of the well. For example, sensors and drilling tools are often provided, which receive power and communicate instructions or data signals with the surface. Often, electrical circuits with these sensors and drilling tools are completed in a down-hole environment, which may include drilling fluids or other liquids. The connection of mating components in a wet down-hole environment is often referred to as a wet-connect.

One type of electrical contact used in wet connects is a spring contact that protrudes from one mating component and exhibits sufficient resiliency and flexibility to maintain contact with a corresponding second mating component when the two mating components are engaged with one another. One concern that affects wet connects is the possibility that a protruding electrical contact will be pinched or forced from their proper location during installation or handling of the tool. This can lead to failure of the tool to establish electrical circuits required for proper operation, and may damage the tool by creating an electrical short circuit. Therefore, there is a need for the retention of resilient electrical contacts within mating components of a wet connect apparatus for use in a down-hole environment.

BRIEF DESCRIPTION

Described herein are example embodiments of a wet connect apparatus including an annular electrical contact formed from a coiled spring. The coiled spring is arranged in a loop, e.g., by having opposing ends of the coil welded or otherwise connected to one another. The loop is disposed within a groove defined on one mating component such that the coiled spring protrudes from the groove to facilitate electrical contact with a corresponding mating component. A radial retention member is disposed within the coiled spring to provide a radial bias to the coiled spring to retain the coiled spring within the groove.

In one embodiment a wet connect apparatus, which is operable in down-hole environments, includes a female component defining an inner annular wall having at least one electrode defined thereon, the at least one electrode in electrical communication with a down-hole tool associated with the female member; a male component at least partially disposed within the inner annular wall, the male component in electrical communication with up-hole equipment; and an annular electrical contact establishing electrical continuity between the male and female components. The annular electrical contact includes a resilient outer member constructed of a coiled spring having its ends fused together; and an inner retention member disposed within the resilient outer member and operable to provide a radial bias to the resilient outer member, the inner retention member constructed of a gift ring defining a coil extending in a direction generally orthogonal to a direction of a coil defining the coiled spring.

In another embodiment, an annular electrical contact for a wet connect apparatus operable in down-hole environments includes a resilient outer member constructed of a coiled spring having its ends fused together; and an inner retention member disposed within the resilient outer member and operable to provide a radial bias to the resilient outer member, the inner retention member constructed of a ring defining a coil extending in a direction approximately orthogonal to a direction of a coil of the coiled spring. The annular electrical contact establishes electrical continuity between down-hole equipment and up-hole equipment.

BRIEF DESCRIPTION OF THE DRAWINGS

So that the manner in which the above-recited features, aspects and advantages of the embodiments, as well as others that will become apparent, are attained and can be understood in detail, a more particular description briefly summarized above may be had by reference to the embodiments thereof that are illustrated in the drawings that form a part of this specification. It is to be noted, however, that the appended drawings illustrate only preferred embodiments and are, therefore, not to be considered limiting of the application's scope, for the application may admit to other equally effective embodiments.

DETAILED DESCRIPTION OF THE EXEMPLARY EMBODIMENTS

Figure 1:
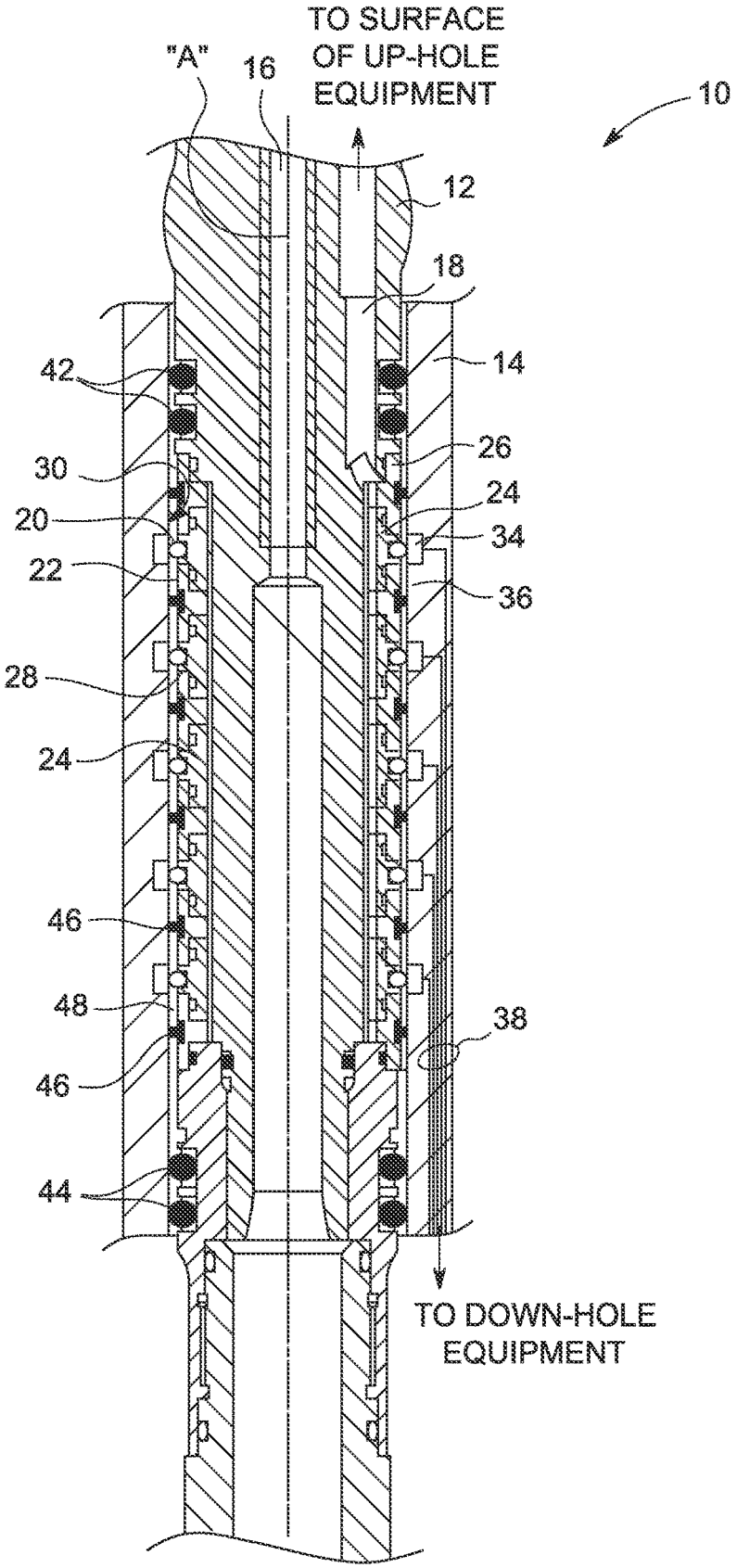
FIG. 1 is a schematic, cross-sectional view of a wet connect apparatus including a male component installed within a female component in accordance with an example embodiment.

Referring generally to FIG. 1, wet connect apparatus 10 includes a male component 12 installed within a female component 14 in accordance with an example embodiment. Male component 12 includes axial bore 16 extending therethrough along longitudinal axis "A." Axial bore 16 provides a path for drilling fluid or other liquids to be pumped down into a wellbore or extracted therefrom. These fluids can contribute to a wet wellbore environment.

Male component 12 includes an electrical conduit 18 extending in an axial direction such that male component 12 can be electrically coupled to surface equipment (not shown) or other wellbore equipment disposed up-hole with respect to wet connect apparatus 10. Electrical conduit 18 is in electrical communication with five (5) annular electrical contacts 20 axially spaced along an outer circumferential wall 22 of the male component 12 to establish electrical communication with female component 14. In other embodiments, more or fewer annular electrical contacts 20 are provided. Outer circumferential wall 22 is defined by conductive rings 24 and electrically insulating rings 26, which are interspaced with one another in an axial direction. Annular electrical contacts 20 are in electrical communication with the electrical conduit 18 through the conductive rings 24. Annular grooves 28 are defined in conductive rings 24, which provide a seat in which annular electrical contacts 20 are retained. Annular electrical contacts 20 resiliently protrude radially from annular grooves 28 beyond outer circumferential wall 22 to engage an inner circumferential wall 30 of female component 14.

Inner circumferential wall 30 is defined by circumferential electrodes 34 and intermediate electrically insulating portions 36 of female component 14. Electrodes 34 can be constructed of copper or other electrically conductive materials, and electrically insulating portions 36 can be constructed of a PEEK polymer (polyether ether ketone), other thermoplastics, a ceramic material or other generally non-conductive materials recognized by those skilled in the art. Electrodes 34 are in electrical communication with electrical conduit 38 extending in an axial direction along female component 14. Electrical conduit 38 can be electrically coupled to a plurality of sensors, motors, or other down-hole tools (not shown) disposed down-hole with respect to wet connect apparatus 10. Thus, by establishing electrical continuity between male component 12 and female component 14 through annular electrical contacts 20, wet connect apparatus 10 facilitates electrical communication between surface equipment and down-hole equipment coupled thereto.

An upper pair of o-rings 42 and a lower pair of o-rings 44 are provided on male component 12 above and below annular electrical contacts 20. O-rings 42, 44 engage inner annular wall 30 of female component to fluidly isolate annular electrical contacts 20 from exterior portions of wet connect apparatus 10. Each annular electrical contact 20 is fluidly isolated from one another by fluid seals 46 disposed above and below each annular electrical contact. Fluid seals 46 extend between electrically insulating rings 26 and electrically insulating portions 36 of female component 14 to engage inner annular wall 30. Fluid seals can be constructed of an elastomer or another dielectric material such that fluid seals permit each annular electrical contact 20 and electrode 34 to transmit distinct power and/or data signals through wet connect apparatus 10. In the event that any wellbore fluid or other fluid is trapped between fluid seals 46 during installation of male component 12 into female component 14, the fluid is maintained in an electrically isolated cavity 48, and thus the trapped fluid does not interfere with the transmission of power and/or data signals through adjacent electrically isolated cavities 48.

Figure 2:
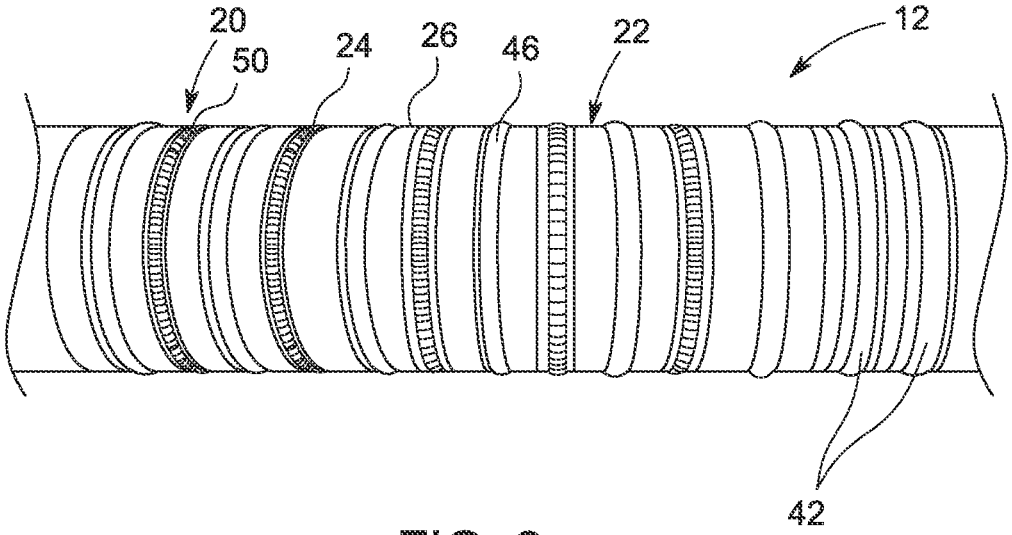
FIG. 2 is a partial, perspective view of the male component of FIG. 1 illustrating a plurality of annular electrical contacts disposed within respective grooves.

Referring now to FIG. 2, male component 12 is depicted with annular electrical contacts 20 disposed within the annular grooves 28. Annular electrical contacts 20 include a resilient outer member 50 protruding radially from the outer circumferential wall 22. In the embodiment illustrated, resilient outer member 50 is constructed of a metallic coiled spring having its ends welded otherwise coupled to one another such that the outer resilient member 50 maintains an annular configuration. The annular configuration maintained by the ends of the coiled spring can exhibit an inner diameter that is slightly smaller than an outer diameter of annular grooves 28 such that the resilient outer member 50 exhibits a radially inward bias to maintain physical and electrical contact with conductive rings 24. In other embodiments (not shown), outer resilient member 50 can be constructed of a flexible metallic mesh, or other resilient and electrically conductive structures.

Figure 3:
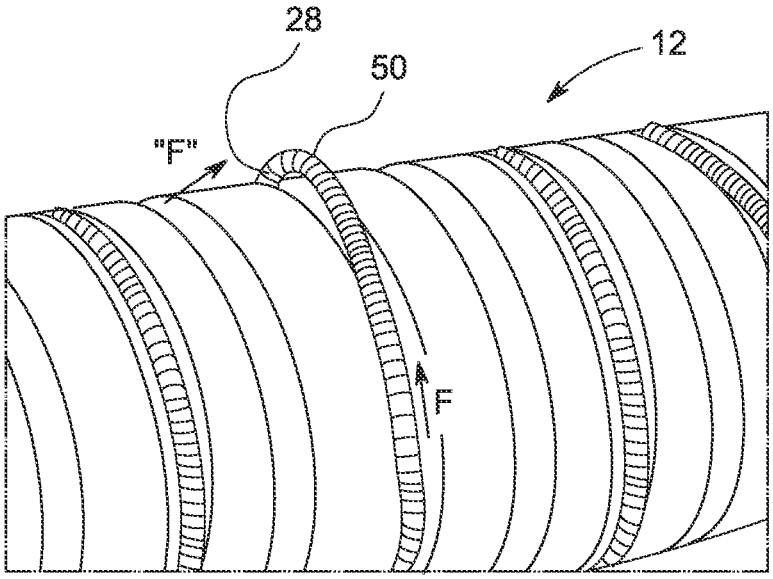
FIG. 3 is a partial, perspective view of the male component of FIG. 1 illustrating a one of the annular electrical contacts pinched such the annular electrical contact is partially displaced from the respective groove.

As illustrated in FIG. 3, one (1) resilient outer member 50 is illustrated with a force "F" applied thereto, which pinches outer resilient member 50, and thereby partially displaces the resilient outer member 50 from annular groove 28. As one skilled in the art recognizes, forces "F" can be applied to outer resilient outer member 50 by ledges, shoulders or other protruding obstacles in a wellbore during insertion of male member 12 into the wellbore prior to engaging female component 14 (FIG. 1). If not properly managed, these forces "F" can cause outer resilient member 50 to roll out of groove 28, thereby causing an electrical short, diminishing electrical continuity and/or rendering wet connect apparatus 10 (FIG. 1) at least partially inoperable.

Figure 4:
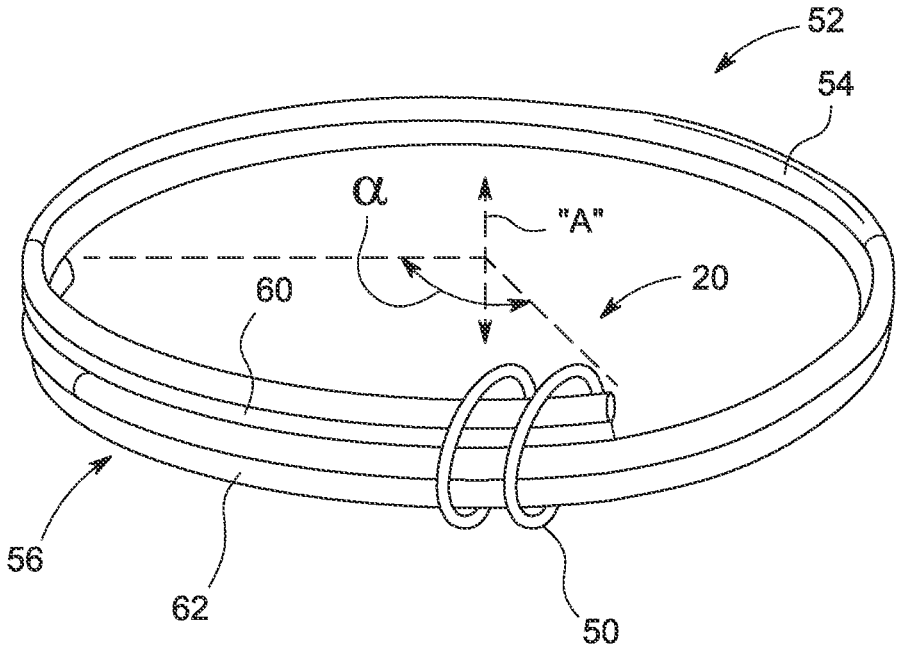
FIG. 4 is a schematic perspective view of the annular electrical contact of FIG. 2.

As illustrated in FIG. 4, an inner retention member 52 is embedded within the coiled structure of resilient member 50 to facilitate maintaining annular electrical contact 20 within groove 28. Only a few coils of resilient outer member 50 are illustrated for clarity, although it will be recognized that resilient outer member extends a full 360 degrees around inner retention member 52. Inner retention member 52 is constructed of a "gift ring," which may be referred to as a "key ring." Inner retention member 52 exhibits a greater rigidity than resilient outer member 50, and includes a metallic rod or wire 54 arranged in one complete coil with an overlapping section 56. Overlapping section 56 extends over a radial angle "$\alpha$" in which a first portion 60 of wire 54 is disposed adjacent a second portion 62 of the wire 54. In some embodiments, radial angle "$\alpha$" is an angle in the range of about 90 degrees to about 150 degrees. In some embodiments, the angle "$\alpha$" is about 120 degrees. In some embodiments, first and second portions 60, 62 of wire 54 abut one another in an unstressed state, and may be axially separated to permit resilient outer member 50 to be installed around the inner retention member 52.

Figure 5:
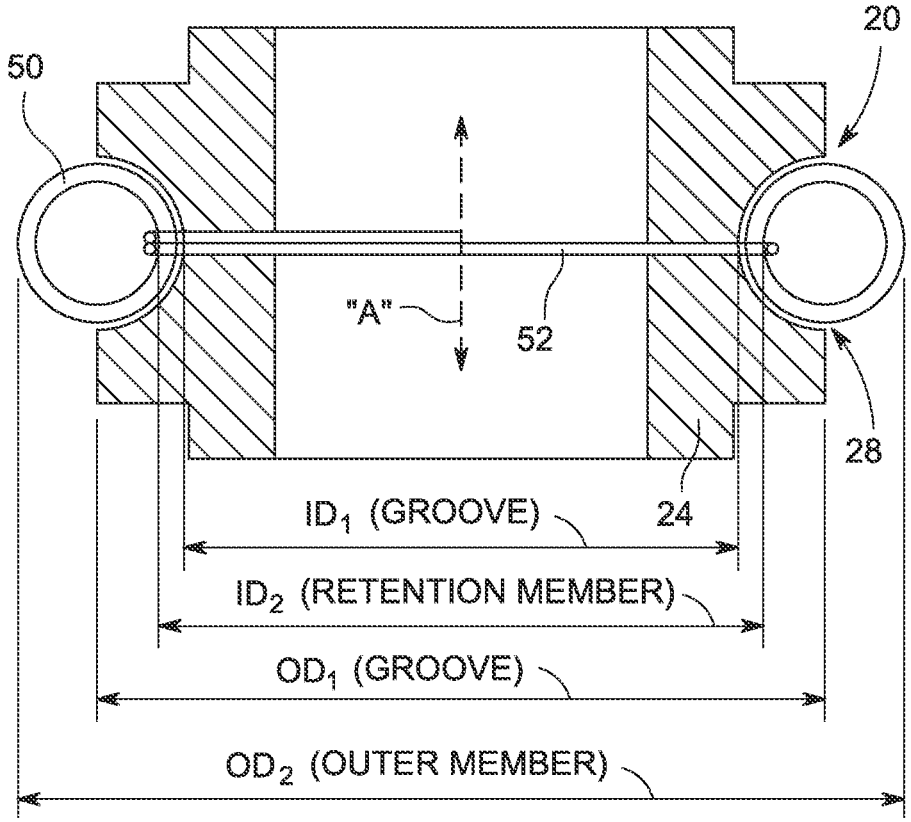
FIG. 5 is a schematic, cross-sectional view of the annular electrical contact of FIG. 2 installed in a respective groove.

As illustrated in FIG. 5, the coils of resilient outer member 50 and inner retention member 52 extend in generally orthogonal directions. The coil of inner retention member 52 extends generally along axis "A" and the coil of inner retention member 52 extends in an annular direction around longitudinal axis "A." In the illustrated embodiment, groove 28 defined in conductive ring 24 has an inner diameter $ID_1$ and inner retention member 52 has an inner diameter $ID_2$ in an unstressed state. A thickness of the coil defining outer resilient member 50 is sufficiently small that the inner diameter $ID_2$ of the inner retention member 52 does not force the resilient outer member 50 into abutment with the inner diameter $ID_1$ of groove 28. Thus, resilient outer member 50 maintains some ability to slide, flex and/or move within groove 28, but is captured within the groove 28 by the inner retention member 52. In other embodiments, the inner diameter $ID_2$ inner retention member is sufficiently small such that inner retention member 52 abuts outer resilient member 50 and provides a radial bias thereto such outer resilient member 50 is actively biased into contact with groove 28.

In the illustrated embodiment, the inner diameter $ID_2$ of the inner retention member 52 is smaller than an outer diameter $OD_1$ of groove 28. Thus, to install or displace annular electrical contact 20 within or from groove 28, the radial bias of inner retention member 52 can be sufficiently overcome temporarily to allow inner retention member 52 to expand over the outer diameter $OD_1$ of groove 28. Thereafter, inner retention member 52 can be returned to an unstressed state (or a less stressed state) to capture annular electrical contact 20 within groove 28. An outer diameter $OD_2$ is defined by resilient outer member 50, which is larger than outer diameter $OD_1$ of groove 28 allowing outer member 50 to establish electrical contact with electrodes 34 (FIG. 1) defined on female component 14 (FIG. 1).

In other alternate embodiments (not shown), an inner retention member can be provided with extends less than a full coil such that there is no overlapping section. For example, the inner retention member can extend a radial angle of about 150 degrees, allowing the inner retention member to provide a radial bias and capture resilient outer member 50 within groove 28. In other alternate embodiments, an inner retention member can be a flexible copper wire with ends tied or fused together such that the flexible copper wire defines a loop with an inner diameter that is smaller than the outer diameter $OD_1$ of groove 28. In still other alternate embodiments, an inner retention member can be provided constructed of an elastic or elastomeric band, and may include electrically conductive or electrically insulating materials.

In one example embodiment of use, resilient outer member 50 is formed by welding opposing ends of a coiled spring to one another to form a loop structure. Inner retention member 52 is then installed by axially separating first and second portions 60, 62 of wire 54 to permit the coil of resilient outer member 50 to be inserted between the first and second portions 60, 62. Prior or subsequent to fully embedding the inner retention member 52 within resilient outer member 50, the annular electrical contact 20 can be installed within groove 28. Male component 12 can then be lowered into a wet wellbore environment in which female component 14 is disposed. In the event that a force "F" is applied to resilient outer member 50 as male member is lowered, inner retention member 52 retains annular electrical contact 20 in groove 28. Even in the event a force "F" is applied that severs the coil of resilient outer member 50, at the welded joint between the two ends or at another location, inner retention member 52 retains annular electrical contact 20 in groove 28. Thus, electrical continuity can be established with a corresponding electrode 34 as the male component 14 is installed within inner circumferential wall 30 of female member 14, even when outer resilient member 50 is damaged.

The embodiments described herein, therefore, are well adapted to carry out the objects and attain the ends and advantages mentioned, as well as others inherent therein. While a presently preferred embodiment has been given for purposes of disclosure, numerous changes exist in the details of procedures for accomplishing the desired results. These and other similar modifications will readily suggest themselves to those skilled in the art, and are intended to be encompassed within the spirit of the present embodiments disclosed herein and the scope of the appended claims.

What is claimed is:

1. A wet connect apparatus operable in down-hole environments, the wet connect apparatus comprising:

a female component defining an inner annular wall having at least one electrode defined thereon, the at least one electrode in electrical communication with a down-hole tool associated with the female component;

a male component at least partially disposed within the inner annular wall, the male component in electrical communication with up-hole equipment; and an annular electrical contact establishing electrical continuity between the male and female components, the annular electrical contact comprising:

a resilient outer member constructed of a coiled spring having its ends fused together; and an inner retention member disposed within the resilient outer member and operable to provide a radial bias to the resilient outer member, the inner retention member constructed of a gift ring defining a coil extending in a direction generally orthogonal to a direction of a coil defining the coiled spring, wherein the inner retention member comprises a complete coil with an overlapping section, and wherein the male component further comprises an outer circumferential wall defined by at least one conductive ring and at least one electrically insulating ring;

the at least one conductive ring and the at least one electrically insulating ring are interspaced in an axial direction; and the at least one conductive ring defines an annular groove, the annular groove providing a seat in which the annular electrical contact is retained.

2. The apparatus of claim 1, wherein the male component comprises the annular electrical contact.

3. The apparatus of claim 1, wherein the resilient outer member extends at least 360 degrees around the inner retention member.

4. The apparatus of claim 1, wherein the inner retention member exhibits a greater rigidity than the resilient outer member.

5. The apparatus of claim 1, further comprising an electrically isolated cavity between the female component and the male component.

6. The apparatus of claim 1, wherein the inner retention member comprises metallic wire arranged in at least one complete coil.

7. The apparatus of claim 6, wherein the at least one complete coil comprises an overlapping section extending over a radial angle in which a first portion of the metallic wire is disposed adjacent a second portion of the wire.

8. The apparatus of claim 7, wherein the first and second portions of the wire abut one another in an unstressed state, and may be axially separated to permit the resilient outer member to be installed around the inner retention member.

9. The apparatus of claim 1, further comprising a fluid seal, wherein the annular electrical contact comprises at least two annular electrical contacts and the fluid seal fluidly isolates the at least two annular electrical contacts from each other.

10. The apparatus of claim 9, wherein the male component further comprises an insulating ring, the female component further comprises an insulating portion, and the fluid seal extends between the insulating ring of the male component and the insulating portion of the female component, the fluid seal engaging the inner annular wall of the female component.

11. The apparatus of claim 1, wherein the male component further comprises an upper pair of o-rings and a lower pair of o-rings that engage the inner annular wall of the female component to fluidly isolate the annular electrical contact.

12. The apparatus of claim 1, wherein the coiled spring has an inner diameter that is slightly smaller than an outer diameter of the at least one annular groove and the annular electrical contact is disposed within the annular groove.

13. The component of claim 12, wherein the annular electrical contact protrudes radially from the annular groove, beyond the outer circumferential wall, to engage the female component.

14. The apparatus of claim 1, wherein the annular groove comprises a semi-circular cross-section.

15. The apparatus of claim 1, wherein the groove has an inner diameter, and the inner retention member has an inner diameter in an unstressed state, wherein a thickness of the coil defining outer resilient member is sufficiently small that the inner diameter of the inner retention member does not force the resilient outer member into abutment with the inner diameter of the groove.

16. A wet connect apparatus operable in down-hole environments comprising:

a female component in electrical communication with a down-hole tool associated with the female component;

a male component in electrical communication with an up-hole equipment;

an annular electrical contact establishing electrical continuity between the male component and the female component, the annular electrical contact comprising:

a resilient outer member constructed of a coiled spring having its ends fused together; and an inner retention member disposed within the resilient outer member and operable to provide a radial bias to the resilient outer member, the inner retention member constructed of a ring defining a coil extending in a direction approximately orthogonal to a direction of a coil of the coiled spring wherein the inner retention member comprises a complete coil with an overlapping section, wherein the male component further comprises an outer circumferential wall defined by at least one conductive ring and at least one electrically insulating ring;

the at least one conductive ring and the at least one electrically insulating ring are interspaced in an axial direction; and the at least one conductive ring defines an annular groove, the annular groove providing a seat in which the annular electrical contact is retained.

17. The apparatus of claim 16, wherein the inner retention member comprises metallic wire arranged in at least one complete coil.

18. The apparatus of claim 17, wherein the at least one complete coil comprises an overlapping section extending over a radial angle in which a first portion of the metallic wire is disposed adjacent a second portion of the wire.

19. The apparatus of claim 18, wherein the radial angle is an angle in the range of about 90 degrees to about 150 degrees.

* * * * *